United States Patent [19]

Abbott

[11] 4,380,140

[45] Apr. 19, 1983

[54] THERMAL BARRIER FOR WINDOWS

[76] Inventor: Joseph L. Abbott, Columbia, S.C.

[21] Appl. No.: 190,796

[22] Filed: Sep. 25, 1980

[51] Int. Cl.[3] ..... E04B 3/26

[52] U.S. Cl. ..... 52/202; 52/222; 160/395

[58] Field of Search ..... 52/202, 203, 222, 63; 160/392, 395

[56] References Cited

U.S. PATENT DOCUMENTS

| | | | |
|---|---|---|---|
| 1,116,501 | 11/1914 | Sennett | 160/397 |
| 1,740,224 | 12/1929 | Cameron . | |
| 1,932,418 | 10/1933 | Milone | 160/394 |
| 2,063,120 | 12/1936 | Plym | 20/56.4 |
| 2,263,511 | 11/1941 | Lindsay | 189/34 |
| 2,325,500 | 7/1943 | Fosberg | 160/383 |
| 2,378,163 | 6/1945 | Thomas | 160/40 |
| 3,187,801 | 6/1965 | Saling | 160/392 |
| 3,273,633 | 9/1966 | Seidmon et al. | 160/381 |
| 3,405,489 | 10/1968 | Frisk | 52/222 |
| 3,487,601 | 12/1967 | James | 52/400 |
| 3,513,902 | 5/1970 | Merillet | 160/392 |
| 3,551,014 | 12/1970 | Tamruchi | 287/189.36 |
| 3,720,256 | 3/1973 | Fralick et al. | 160/392 |
| 3,783,931 | 1/1974 | Assael | 52/222 |
| 4,103,728 | 8/1978 | Burdette | 160/392 |
| 4,133,367 | 1/1979 | Abell | 160/392 |
| 4,189,880 | 2/1980 | Ballin | 52/202 |
| 4,214,411 | 7/1980 | Pickett | 52/222 |
| 4,233,790 | 11/1980 | Meadows | 52/222 |

FOREIGN PATENT DOCUMENTS

| | | | |
|---|---|---|---|
| 2332688 | 1/1975 | Fed. Rep. of Germany | 52/222 |

*Primary Examiner*—Alfred C. Perham
*Assistant Examiner*—Henry E. Raduazo
*Attorney, Agent, or Firm*—Body, Vickers & Daniels

[57] ABSTRACT

A thermal barrier is mounted in a window opening in inwardly spaced relationship with respect to the existing window in the opening. The thermal barrier is comprised of individual channel members mounted on the header, sill and upright side members of the window frame so as to provide a peripheral opening about the window facing inwardly of the window opening. A sheet of rigid thermoplastic film material has horizontal and vertical edges received in a corresponding portion of the opening provided by the channel members, and the edges of the sheet are frictionally interengaged with corresponding side walls of the channel members by U-shaped retaining members removably received in each of the channel members with the legs of the U extending toward the bottom wall of the channel. The upper edge of the sheet is provided with a flange integral with the sheet along a fold line therebetween, and one of the legs of the retaining member received in the channel member mounted on the header component of the window frame engages the sheet along the fold line to vertically hold the sheet in the corresponding channel member.

10 Claims, 7 Drawing Figures

THERMAL BARRIER FOR WINDOWS

BACKGROUND OF THE INVENTION

This invention relates to the art of insulating devices for building windows and, more particularly, to a thermal barrier mountable interiorly of an existing building window.

It is of course well known to provide an existing building window with an insulating arrangement to reduce heat transfer between the inside and outside of the building through the window and across the junction between the window and its supporting framework. Such insulating arrangements have included, for example, storm windows of wood or metal construction mounted exteriorly of the building window. Such storm windows are not only expensive to manufacture and cumbersome to install, but also are difficult to seal peripherally against leakage between the frame thereof and the building wall or existing window frame. Moreover, if the storm window is of a construction providing sliding window panels, provision for such sliding requires clearance which necessarily creates leakage paths between the frame and the window panels supported thereby. Additionally, such exterior storm windows are exposed to adverse weather conditions including rain, wind and snow and, while they offer protection for the building window from such adverse conditions, they must in turn have sufficient structural integrity to withstand such conditions, thus adding to the size, weight and cost thereof. Efforts have been made to reduce the weight and improve the weather resistance of such storm windows by producing the same from plastic materials, but the latter efforts have not been acceptable for commercial application, and acceptance thereof for residential use has been limited. In any event, such plastic constructions do not avoid air leakage problems and, accordingly, provide no better protection against heat transfer between the inside and outside of a building than do metal or wooden storm windows.

Other efforts heretofore employed to reduce heat transfer, especially in individual homes, have included the covering of a window opening with a thin sheet of flexible plastic material spanning the window opening either interiorly or exteriorly of the existing window. Such a plastic sheet is mounted by taping or stapling the sheet to frame components bounding the window opening, or by rigidly attaching the edges of the sheet material to rigid support members of wood or the like which in turn are nailed or screwed to the window frame components. While such arrangements afford some protection against undesired heat transfer, they are aesthetically unattractive and, if mounted interiorly of the building, do not afford access to the building window, such as for cleaning the latter, without physically damaging the sheet material and/or the window framing by removal of the plastic sheet from the window framing. Moreover, the side of the plastic sheet material facing outwardly toward the existing window cannot be cleaned without removal of the sheet from the window frame and, if the plastic is left uncleaned so as to prevent damage thereto and/or to the window framing, this further detracts from the aesthetic value of the interior of the building. Still further, window framing is often out of square, whereby it is practically impossible to avoid wrinkling of the plastic material, and such wrinkling of course further detracts from the desired appearance of the interior of the building.

SUMMARY OF THE INVENTION

In accordance with the present invention, a thermal barrier is provided for insulating existing building windows and by which the foregoing and other disadvantages of window insulating arrangements heretofore provided are advantageously avoided or minimized. More particularly in this respect, the thermal barrier according to the present invention is mountable interiorly of an existing window and is comprised of a supporting structure mountable on the window frame or other surface defining the window opening. The supporting structure removably receives a sheet of rigid thermoplastic film material and frictionally holds the sheet in place against unintentional removal and in a manner which tensions the sheet to avoid wrinkling and to minimize distortion thereof from a planar condition. Furthermore, frictional interengagement of the sheet with the supporting structure optimizes sealing against leakage of air across the barrier.

Preferably, the supporting structure is defined by a plurality of plastic channel members each mounted on a surface of the window opening so as to face inwardly of the opening, and a corresponding plurality of plastic retaining elements received in the channels and frictionally interengaging the corresponding edge of the sheet material against a side wall of the channel. Preferably, the edge of the sheet material received in the channel at the top of the window opening is provided with a flange, and the corresponding retaining member interengages with the flange so as to vertically hold the upper edge of the sheet material in the channel. Thus, upon inserting the retaining member in the channel on the lower surface of the window opening, the sheet is frictionally tensioned downwardly. While the frictional interengagement between the channel members and retaining members is sufficient to maintain the retaining members in the channel members, the channel members and retaining members are preferably provided with an interengaging arrangement which restrains unintentional displacement of the retaining members from the channel members. The channel members can be mounted on the surfaces of the window opening in any suitable manner and, preferably, are so mounted by a double faced adhesive tape therebetween so as to optimize sealing against leakage of air across the supporting structure.

The channel members and retaining members are advantageously extrudable in indeterminate lengths which can be cut to size in accordance with the dimensions of the window opening. The rigid thermoplastic sheet material can be provided in rolls of indeterminate length from which a sheet of desired size is cut, and the flange at the upper edge of the sheet can readily be provided by a simple heating and bending tool. The use of individual channel members and retaining members for the supporting structure, and the frictional interengagement between the sheet material and the supporting structure, advantageously enables the thermal barrier to be mounted in a window opening which is out of square without wrinkling of the plastic material due to such out of squareness. In this respect, the length and width dimensions of the plastic sheet can be reduced as is necessary to compensate for the out of square condition of the window opening so long as such reduction of the sheet dimensions is not greater than the depth of the channel members from the point of frictional engagement of the sheet therewith to the bottom of the channel.

The thermal barrier is economical to produce and install, and is of a pleasing appearance in the building room in which it is installed. In this respect, the rigidity of the plastic sheet together with the tensioning and frictional retention thereof enables obtaining and maintaining a visually desirable planar disposition of the sheet. Moreover, to further promote the aesthetic value, the supporting structure for the sheet can be colored to blend with the adjacent color of the window framing in which the thermal barrier is mounted. Still further, the plastic sheet can readily be removed from the supporting structure for cleaning, and such removal and subsequent replacement of the plastic sheet is achieved without detaching the supporting structure from the window framing, thus protecting the latter from physical damage, and without damaging the sheet material. It will be appreciated too that the plastic sheet can be so removed to provide access to the existing window for opening and closing and/or cleaning the window. Furthermore, the thermal barrier cooperates with the existing window and window opening to provide a dead air space by which heat transfer between the inside and outside of the building is substantially reduced. The reduction of heat transfer is optimized by the sealing achieved through frictional interengagement between the plastic sheet and its supporting structure, and by sealing between the window opening and the supporting structure for the sheet. Integrity of the latter sealing is enhanced by the interior mounting of the thermal barrier, whereby the sealing material is not exposed to external weather conditions. With further regard to minimizing heat transfer, the plastic sheet material can be tinted, or metalized to provide for the sheet to be reflective. Preferably, such tinting or metalizing would be such as to provide for the plastic sheet to be translucent.

It is accordingly an outstanding object of the present invention to provide an improved thermal barrier for insulating existing building windows.

Another object is the provision of a thermal barrier of the foregoing character which is mountable in a window opening interiorly of the existing window so as to provide a dead air space therebetween.

Yet another object is the provision of a thermal barrier of the foregoing character which includes a sheet of plastic material and a supporting structure therefor and with which the sheet is interengaged in a manner which optimizes sealing against leakage of air between the sheet and its supporting structure.

A further object is the provision of a thermal barrier of the foregoing character in which the sheet material and its supporting structure are interengaged in a manner which tensions the sheet to provide for maintaining the sheet in a planar condition.

Yet a further object is the provision of a thermal barrier of the foregoing character in which the plastic sheet material and its supporting structure are interengaged for the sheet to be readily removed and replaced with respect thereto without damaging the sheet material or the supporting surfaces of the window opening on which the supporting structure is mounted.

Another object is the provision of a thermal barrier of the foregoing character in which the supporting structure for the sheet material is mountable in a window opening which is out of square and in which the sheet material and supporting structure interengage in a manner which enables compensating for such out of squareness without wrinkling or distortion of the sheet material.

Still another object is the provision of a thermal barrier of the foregoing character which is economical to produce, easy to install, efficient in retarding heat transfer, and pleasing in appearance when installed.

BRIEF DESCRIPTION OF THE DRAWINGS

The foregoing objects, and others, will in part be obvious and in part be pointed out more fully hereinafter in conjunction with the written description of a preferred embodiment of the invention illustrated in the accompanying drawings in which.

DESCRIPTION OF A PREFERRED EMBODIMENT

Figure 1:
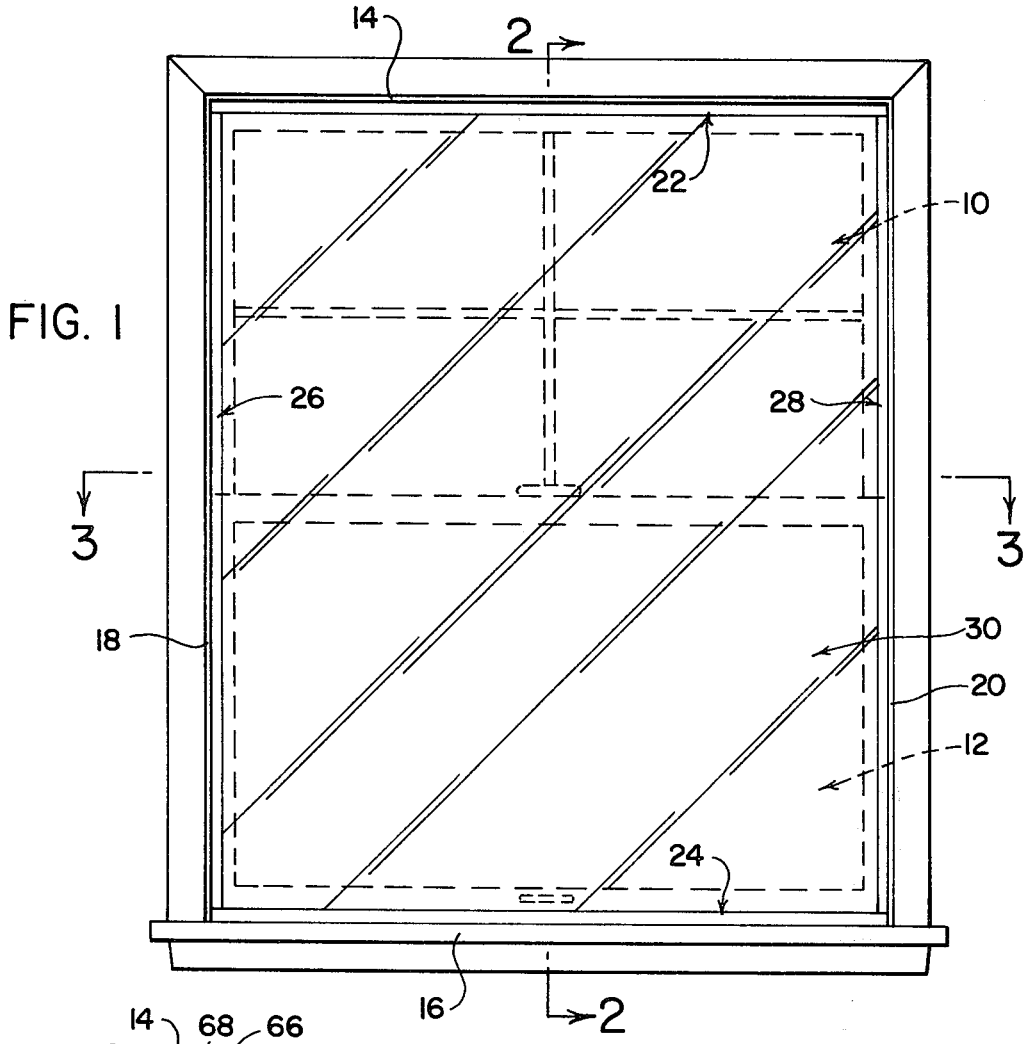
FIG. 1 is a front elevation view of a thermal barrier according to the present invention mounted in a residential type window opening.
Figure 2:
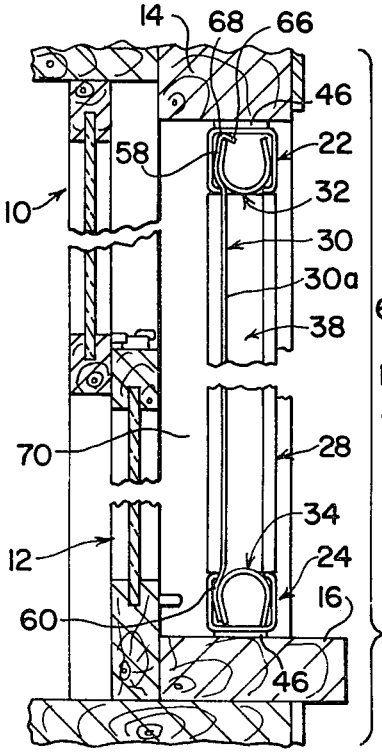
FIG. 2 is a sectional elevation view of the window and thermal barrier taken along line 2—2 in FIG. 1.
Figure 3:
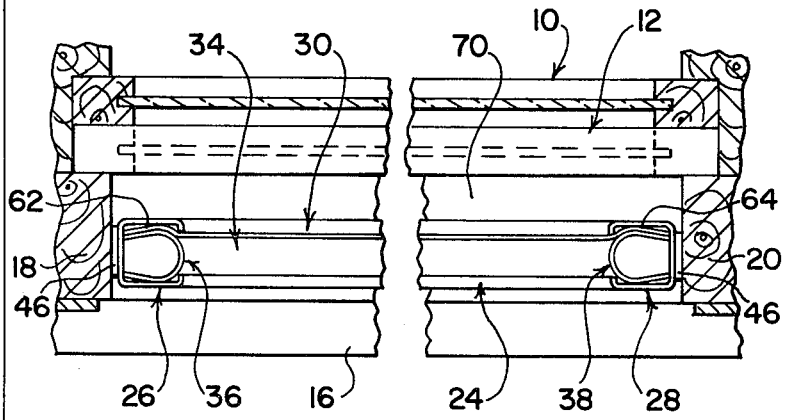
FIG. 3 is a cross-sectional view of the window and thermal barrier taken along line 3—3 in FIG. 1.

Referring now in greater detail to the drawings wherein the showings are for the purpose of illustrating a preferred embodiment of the invention only, and not for the purpose of limiting the invention, a thermal barrier according to the present invention is illustrated in FIGS. 1–3 as being mounted in inwardly spaced relationship with respect to a window of the type having vertically slidable upper and lower window sashes 10 and 12, respectively. The window sashes are mounted in a window opening surrounded by a window frame including vertically spaced apart header and sill frame members 14 and 16, respectively, and horizontally spaced apart side frame member 18 and 20. Frame members 14 and 16 provide a pair of horizontally extending mounting surfaces and frame members 18 and 20 provide a pair of vertically extending mounting surfaces, all of which surfaces extend transverse to the planes of the window sashes 10 and 12.

The thermal barrier includes a supporting structure mountable in the window opening and comprised of upper and lower channel members 22 and 24, respectively, and a pair of side channel members 26 and 28. Channel members 22 and 24 are respectively mounted on the mounting surfaces of frame members 14 and 16 and extend between side frame members 18 and 20, and side channel members 26 and 28 are respectively mounted on the mounting surfaces of side frame members 18 and 20 and extend vertically between upper and lower channel members 22 and 24. The thermal barrier further includes a sheet 30 of rigid thermoplastic film material having edges received in channel members 22, 24, 26 and 28 and interengaged therewith by U-shaped retaining members 32, 34, 36 and 38 which are removably received in and coextensive with channel members 22, 24, 26 and 28, respectively.

Figure 4:
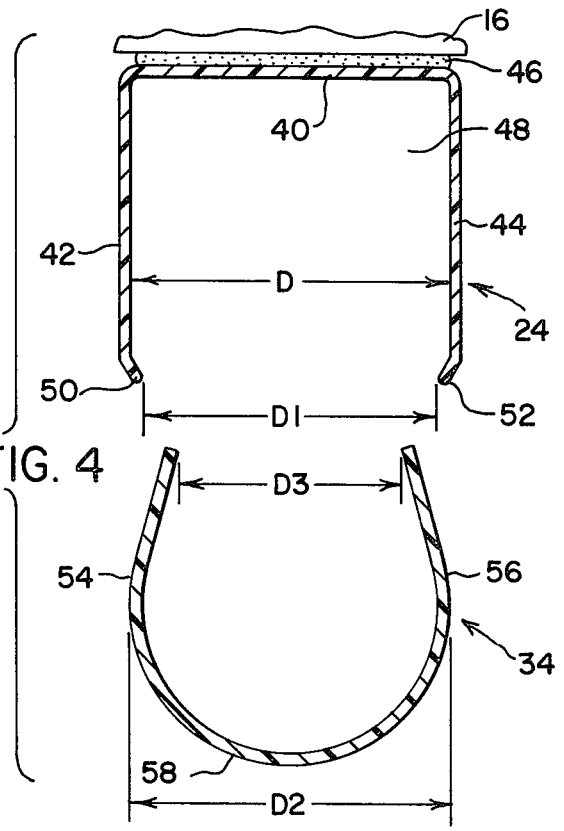
FIG. 4 is an enlarged cross-sectional view of a channel member and a retaining member of the thermal barrier; and, FIGS. 5, 6 and 7 are enlarged cross-sectional views of the top channel member and retaining member of the thermal barrier and showing, in sequence, the structural interrelationships therebetween during the assembly of the upper edge of the plastic sheet therewith.

The four channel members are structurally identical in cross-section, as are each of the four retaining members associated therewith, whereby it will be appreciated that the following description of channel member 24 and the corresponding retaining member 34 illustrated in FIG. 4 of the drawing is applicable to all of the channel members and retaining members. As seen in FIG. 4, each channel member includes a bottom wall 40 and spaced apart side walls 42 and 44 integral with bottom wall 40 and extending therefrom inwardly with respect to the window opening when the channel member is mounted on the corresponding window frame member which, for channel member 24, is window frame member 16. Such mounting is preferably achieved by a double faced adhesive strip 46 between the window frame member and bottom wall 40, although it will be appreciated that the channel member could be mounted on the window frame member by mechanical fasteners such as nails or screws. A double faced adhesive is preferred for such mounting in that it also provides a seal between the channel member and window frame member against leakage of air therebetween and which seal, for optimum efficiency of the thermal barrier, would have to be applied separately in connection with the use of mechanical fasteners. Bottom wall 40 and side walls 42 and 44 of channel member 24 provide an opening 48 facing inwardly of the window opening, whereby it will be appreciated that channel members 22, 24, 26 and 28 together provide opposed pairs of horizontally and vertically extending openings facing inwardly of the window opening. The inner ends of side walls 42 and 44 of the channel member terminate in laterally inwardly directed lips 50 and 52, respectively, which are coextensive with the side walls and are cooperable with the corresponding retaining member as set forth hereinafter to restrain separation of the retaining member from the channel member. Side walls 42 and 44 of channel member 24 are parallel to one another, and the inner surfaces thereof are spaced apart to provide opening 48 with a dimension D in the direction between legs 42 and 44. Lips 50 and 52 on the inner ends of side walls 42 and 44 provide for the entrance into opening 48 to have a dimension D1 which is slightly less than dimension D.

As further seen in FIG. 4, retaining member 34 is of a generally horseshoe contour in cross-section and includes a pair of legs 54 and 56 integrally interconnected by an arcuate bridging portion 58 therebetween. Retaining member 34 has a major dimension D2 across the outer surfaces of legs 54 and 56 which, with respect to dimension D of opening 48 in channel member 24, provides an interference fit between legs 54 and 56 of the retaining member and walls 42 and 44 of the channel member when the retaining member is disposed in the channel member. Further, the horseshoe configuration of retaining member 34 provides for legs 54 and 56 thereof to be spaced apart at the free ends thereof a dimension D3 which is less than dimension D1 of the channel member to promote guidance of the retaining member during introduction thereof into the channel member.

Referring again to FIGS. 2 and 3, it will be seen that plastic sheet 30 includes vertically spaced apart horizontally extending upper and lower marginal edges 58 and 60 respectively disposed in channel members 22 and 24, and horizontally spaced apart vertically extending marginal side edges 62 and 64 respectively disposed in channel members 26 and 38. Top edge 58 of sheet 30 is provided with a flange 66 which, preferably, is integral with the sheet along a fold line 68. Flange 66 extends downwardly and inwardly of inner side **30*a* of sheet 30** at an acute angle with respect thereto.

Figure 5:
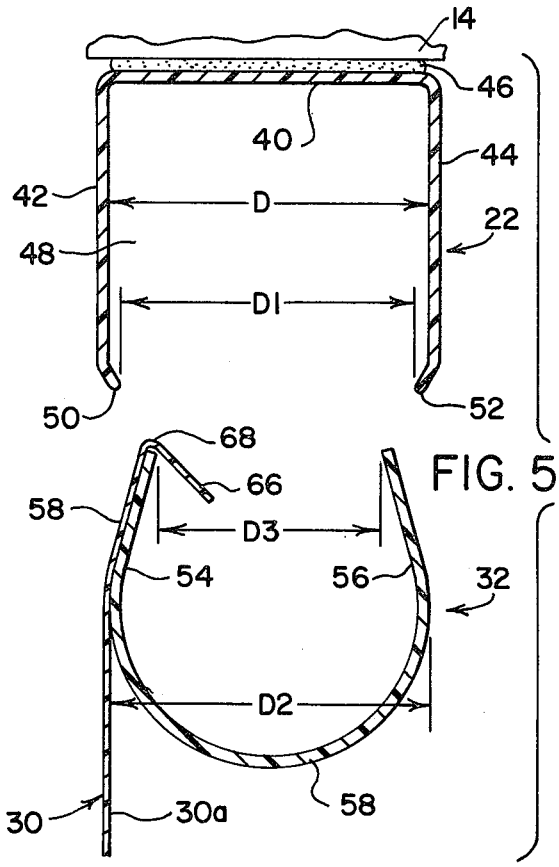
Figure 6:
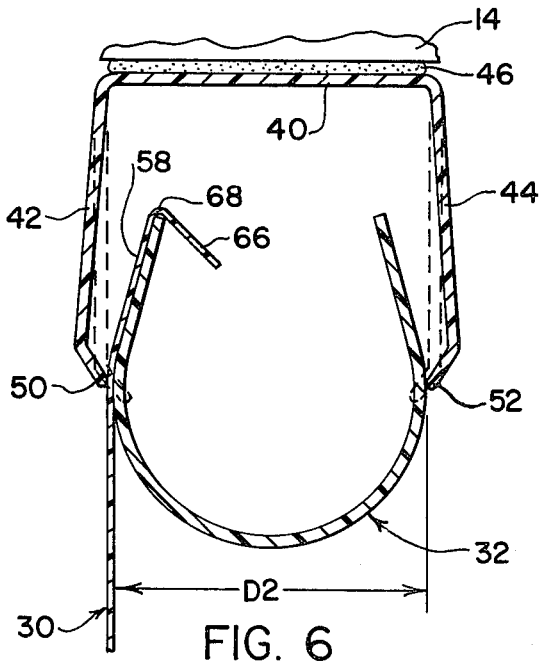
Figure 7:
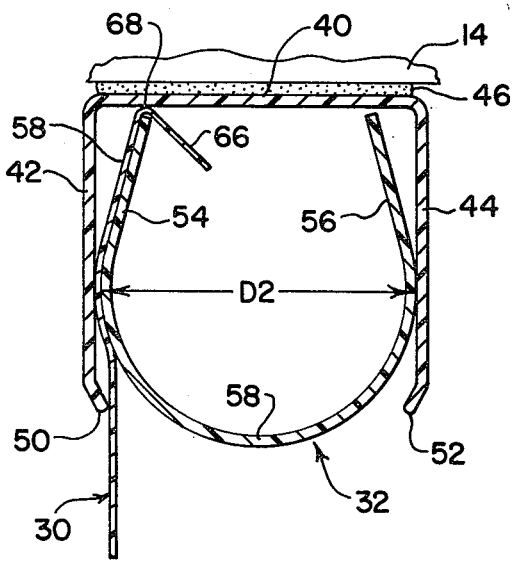

With regard to mounting the thermal barrier in a window opening, upper and lower channel members 22 and 24 are cut to length and mounted on window frame members 14 and 16 between side frame members 18 and 20, and side channel members 26 and 28 are cut to length and mounted on the side frame members of the window between channel members 22 and 24. Then, as will be appreciated from the sequence of steps shown in FIGS. 5–7 of the drawing, leg 54 of upper retaining member 32 is engaged in the fold between upper edge 58 of sheet 30 and flange 66 thereon, and retaining member 32 and the upper edge of sheet 30 are moved into channel member 22. This interengagement is achieved, for example and with reference to FIG. 1, by inclining retaining member 32 and sheet 30 for the right hand end thereof to be below the left hand end, and then introducing the left hand end into the left hand end of channel member 22 through the upper end of side channel member 26. The right hand end of retaining member 32 is then moved upwardly so as to progressively introduce the retaining member and edge 58 of sheet 30 into channel member 22 from left to right with respect to FIG. 1. During such interengagement, as seen in FIG. 6, the major dimension D2 of retaining member 32 causes channel walls 42 and 44 to flex outwardly and, when retaining member 32 is fully seated in channel member 22, as seen in FIG. 7, channel walls 42 and 44 are displaced back towards the initial position thereof by the inherent resiliency of the plastic material thereof. It will be appreciated from the foregoing description of the interference fit between the channel walls and the retaining member that the portion of sheet 30 interposed therebetween is thus clampingly engaged in channel member 22. As will further be seen from FIG. 7, when retaining member 32 is fully seated in channel member 22, the point of major dimension D2 is spaced inwardly from channel lips 50 and 52 at the outer ends of channel walls 42 and 44. This allows a limited downwardly displacement of retaining member 22 and thus sheet 30 before the area of the retaining member adjacent major dimension D2 encounters the restriction defined by lips 50 and 52 on the channel walls. After such displacement, lips 50 and 52 restrain withdrawal of retaining member 32 from channel member 22.

After upper edge 58 of sheet 30 is interengaged with channel member 22 in the foregoing manner, or during such interengagement, side edges 62 and 64 and bottom edge 60 of sheet 30 are threaded into the opening provided by the corresponding channel member. Lower retaining member 34 is then introduced into lower channel member 24 in a manner similar to that described hereinabove with regard to upper retaining member 32. During such introduction of retaining member 34 into channel member 24, the downward movement of the retaining member along bottom edge 60 of sheet 30 frictionally tensions sheet 30 downwardly to provide the desired planar condition of the sheet. When retaining member 34 is fully seated in channel member 24, lower edge 60 of the sheet is clampingly interengaged between the adjacent channel wall and leg of retaining member 34. It will be appreciated that such tensioning of sheet 30 during introduction of retaining member 34 into channel member 24 results from an ironing type action as the area of major dimension D2 of the retaining member moves inwardly across lips 50 and 52 of the channel member and then inwardly along the side walls of the channel member with edge 60 therebetween. It will be further appreciated that during such downward tensioning of sheet 30 leg 54 of upper retaining member 32 engages upper edge 58 of sheet 30 along fold line 68 between the upper edge and flange 56 to restrain downward displacement of sheet 30.

After the upper and lower edges of sheet 30 are so interengaged with channel members 22 and 24, vertical or side retaining members 36 and 38 are introduced into the side channels 26 and 28. It will be appreciated that the introduction of the latter retaining members into the corresponding channel member frictionally tensions the sheet material laterally outwardly and clampingly interengages side edges 62 and 64 of the sheet in the channel members in the manner described with respect to channel member 24 and retaining member 34. When so installed, as seen in FIGS. 2 and 3 of the drawing, sheet 30 is parallel to window panels 10 and 12 and is spaced inwardly therefrom to provide a dead air space 70 therebetween. Dead air space 70 is peripherally sealed by mounting tape 46 between the channel members and window frame members and by the clamping engagement of the edges of sheet 30 in the channel members.

Referring again to FIG. 7, the location of major dimension D2 of retaining member 32 from bottom wall 40 of channel member 22 and from the restriction defined by lips 50 and 52, advantageously enables the thermal barrier to be mounted in a window opening in which the frame members are out of square. In this respect, it will be appreciated that retaining member 32 associated with upper channel 22 and thus upper edge 58 of sheet 30 can move downwardly a short distance from one end of channel member 22 toward the other to compensate for top window frame member 14 being slightly inclined with respect to horizontal. Furthermore, since bottom edge 60 and side edges 62 and 64 of sheet 30 are flat, the latter edges can interengage with the corresponding channel wall and retaining member leg at any location outwardly from the bottom wall of the channel to the point of major dimension D2 of the retaining member and still remain clampingly interengaged therebetween. Accordingly, it will be appreciated that these relationships enable compensation for out of squareness of the window frame members with the adjacent edges of sheet 30 in squared relationship with respect to one another.

In the preferred embodiment, the channel members and retaining members are extruded and are comprised of a rigid thermoplastic such as ABS, PVC or HIPS. As an example of dimensions of the component parts by which the desired characteristics are achieved, the walls of the channel members are each of a thickness of about 0.032 inch, and each channel member has a depth of about $\frac{5}{8}$ inch and a width dimension D of about $\frac{5}{8}$ inch. The legs and bridging portion of the retaining members have a thickness of about 0.042 inch, and each retaining member has a major dimension D2 which provides an interference fit with channel dimension D of about 0.010 inch without the edge of sheet material 30 therebetween. Further, dimension D2 is at a location to engage the channel walls about $\frac{1}{8}$ inch inwardly therealong from lips 50 and 52. This relationship advantageously provides for the top and bottom window frame members or the side frame members to be out of square about $\frac{1}{4}$ inch while still providing about $\frac{1}{8}$ inch of the sheet material to be disposed inwardly of the channel side walls from the point of engagement thereof between the channel member and the corresponding retaining member. Sheet 30 is a film of rigid thermoplastic material such as PVC or PET, preferably having a thickness of about 6 to 8 mils. However, sheet 30 could have a thickness of about 1 mil or greater than 8 mil. A thickness of from 6–8 mils is preferred in that such thickness provides good rigidity against blowout of the film from its supporting structure by outside air, and maintenance of the sheet in a planar condition, while providing sufficient flexibility for the sheet to be manipulated into the channel members during installation. It will be appreciated that the term rigid in connection with the film material, channel members and retaining members means that the plastic material is unplasticized. Thus, while the material is physically flexible, it has rigidity against unintentional flexure. Sheet 30 can be clear, but preferably, is tinted or metalized on one side thereof. Such tinting or metalizing would preferably provide for the sheet to be translucent, and metalizing advantageously provides reflectively for the sheet material.

While the window in connection with the preferred embodiment is illustrated as being of the type including vertically slidable window sashes surrounded by a frame including frame members on which the channel members of the thermal barrier are mounted, it will be appreciated that the thermal barrier can be employed with other types of windows and in any window opening providing horizontally and vertically spaced apart pairs of surfaces adapted to support the channel members for the latter to open inwardly parallel to the plane of the window. In such other window openings, the surfaces might be defined, for example, by plaster or other wall surfaces surrounding and transverse to the window opening. Further, while it is preferred to mount the channel members by means of adhesive strips between the bottom walls of the channels and window frame members, as shown in the drawings, whereby the channel members are inside the window opening as defined by the frame members, the channel members can be mounted on the surface of the frame member facing inwardly of the room, or on wall surfaces surrounding the window opening and facing inwardly of the room, or on a combination of such surfaces and the still member of the window frame. For example, with reference to FIGS. 2 and 3, top channel member 22 and side channel members 26 and 28 could be mounted on the moulding strips on the room side of frame members 14, 18 and 20, which strips are not designated numerically, by interposing adhesive strips 46 between a side wall of the channel member and the corresponding moulding strip. Bottom channel member 24 would be mounted on sill 16 as shown, but would be moved inwardly with respect to the room for alignment with the top and side channel members. Such a mounting arrangement might be necessary, for example, when a sash handle would interfere with the barrier if mounted within the frame as illustrated in the drawings.

While considerable emphasis has been placed on the structures and structural interrelationships between the channel members and the retaining members, it will be appreciated that the structures herein illustrated and described can be modified without departing from the principles of the present invention. For example, the channel members could be of a more rigid construction than the retaining members, whereby the legs of the retaining members would flex inwardly toward one another during introduction of the retaining members into the channel members, as opposed to the channel walls flexing as illustrated and described herein. Furthermore, it will be appreciated that the channel members and/or retaining members could be produced from thin metal as opposed to plastic without changing the desired relationship with respect to interengagement therebeteen and interengagement of the edges of the plastic sheet material therebetween. Still further, it will be appreciated that the channel members and retaining members can have other cross-sectional configurations than that shown in the accompanying drawings, and that the interengagement therebetween against unintentional separation of the retaining members from the channel members can be achieved other than by lips on the side walls of the channel members as herein illustrated and described. Moreover, while it is preferred to provide the upper edge of the sheet material with an integral flange, the flange or its equivalent could be an attachment on the sheet and, in either case, could be of a contour relative to the sheet other than that illustrated and described herein.

Since many embodiments of the present invention can be made, and since many changes can be made in the embodiment herein illustrated and described, it is to be distinctly understood that the foregoing descriptive matter is to be interpreted as merely illustrative of the present invention and not as a limitation.

Having thus described the invention, the following is claimed:

1. A thermal barrier for a window in a window opening including means providing spaced apart pairs of horizontal and vertical surfaces extending about the window opening comprising, a channel member mountable on each said surface and having a bottom wall transverse to said window and a pair of spaced apart side walls extending inwardly from said bottom wall parallel to said window, a sheet of rigid plastic film material having opposite sides and spaced apart pairs of planar horizontal and vertical edges each received in a corresponding one of said channel members between said side walls thereof and parallel to said window, the upper one of said pair of horizontally extending edges including rigid flange means extending at an angle with respect to one of said opposite sides of said sheet, a retaining member removably received in each channel member and including a leg frictionally engaging the corresponding edge of said sheet against one of the side walls of the corresponding channel member and in the direction toward the bottom wall of the channel member, said lower one of said pair of horizontally extending edges and said pair of vertical edges each terminating adjacent the juncture between said one side wall and the bottom wall of said corresponding channel member, said leg of the retaining member in the channel member receiving said upper one of said pair of horizontally extending edges of said sheet engaging said flange means in the direction toward the bottom wall of the corresponding channel member.

2. A thermal barrier according to claim 1, wherein said sheet of plastic material is tinted.

3. A thermal barrier according to claim 1, wherein one of said opposite sides of said sheet is provided with a metal coating.

4. A thermal barrier according to claim 1, wherein said retaining member includes a second leg spaced from said first mentioned leg in the direction toward the other side wall of said corresponding channel member and a bridging portion between said legs.

5. A thermal barrier according to claim 1, wherein each said channel member and the corresponding retaining member includes means to restrain separation of said retaining member from said corresponding channel member.

6. A thermal barrier for a window in a window opening including means providing spaced apart pairs of horizontal and vertical surfaces extending about the window opening comprising, a channel member mountable on each said surface and having a bottom wall transverse to said window opening and a pair of spaced apart side walls extending from said bottom wall inwardly of said window opening, a sheet of plastic film material having opposite sides and spaced apart pairs of horizontal and vertical edges each received in a corresponding one of said channel members between said side walls thereof, the upper one of said pair of horizontally extending edges including flange means extending at an angle with respect to one of said opposite sides of said sheet, a retaining member removably received in each channel member and including a leg frictionally engaging the corresponding edge of said sheet against one of the side walls of the corresponding channel member, said leg of the retaining member in the channel member receiving said upper one of said pair of horizontally extending edges of said sheet and engaging said flange means in the direction toward the bottom wall of the corresponding channel member, said retaining member including a second leg spaced from said first mentioned leg in the direction toward the other side wall of said corresponding channel member and a bridging portion between said legs, said side walls of each said channel member having outer edges terminating in laterally inwardly extending lips spaced apart a given distance, said legs and bridging portion of each said retaining member including laterally opposite sides each underlying a different one of said lips of the corresponding channel member when said retaining member is received therein, said opposite sides of said legs and bridging portion being spaced apart a distance greater than said given distance, and said side walls of said channel member and said legs and bridging portion of said retaining member being relatively displaceable laterally to enable insertion and removal of said retaining member from said channel member.

7. A thermal barrier according to claim 6, wherein said channel members and said retaining members are plastic.

8. A thermal barrier according to claim 7, wherein said flange means is integral with said sheet along a fold line therebetween, and said one leg of said retaining member engages said sheet along said fold line.

9. A thermal barrier according to claim 8, wherein said sheet of plastic material is tinted.

10. A thermal barrier according to claim 8, wherein one of said opposite sides of said sheet is provided with a metal coating.

* * * * *